US009856717B2

(12) United States Patent
Kennedy

(10) Patent No.: US 9,856,717 B2
(45) Date of Patent: Jan. 2, 2018

(54) SLOT ACTUATED DOWNHOLE TOOL

(71) Applicant: Shale Oil Tools, LLC, Sugar Land, TX (US)

(72) Inventor: Brian Kennedy, Sugar Land, TX (US)

(73) Assignee: Shale Oil Tools, LLC, Sugar Land, TX (US)

( * ) Notice: Subject to any disclaimer, the term of this patent is extended or adjusted under 35 U.S.C. 154(b) by 654 days.

(21) Appl. No.: 14/474,549

(22) Filed: Sep. 2, 2014

(65) Prior Publication Data

US 2016/0061002 A1 Mar. 3, 2016

(51) Int. Cl.
*E21B 34/14* (2006.01)
*E21B 34/00* (2006.01)

(52) U.S. Cl.
CPC ..... *E21B 34/14* (2013.01); *E21B 2034/007* (2013.01)

(58) Field of Classification Search
CPC .... E21B 34/14; E21B 2034/007; E21B 34/00; E21B 34/06; E21B 43/25; E21B 43/14; E21B 43/11; E21B 33/12; E21B 33/16
See application file for complete search history.

(56) References Cited

U.S. PATENT DOCUMENTS 7,892,043 B1 2/2011 Orand
2005/0257936 A1 11/2005 Lehr
2011/0011597 A1 1/2011 Fay
2012/0168163 A1 7/2012 Bertoja
2012/0227980 A1 9/2012 Fay
2013/0175033 A1 7/2013 Baihly

OTHER PUBLICATIONS

International Search Report and Written Opinion dated Dec. 4, 2015 for PCT/US2015/47775 filed Aug. 21, 2015.

*Primary Examiner* — Wei Wang
(74) *Attorney, Agent, or Firm* — The Kubiak Law Firm, PLLC

(57) ABSTRACT

In wellbore completions it is desirable to access multiple formation zones in a single well where the more formation zones that can be accessed tend to make the well increasingly economically viable. In an embodiment of the current invention a dart having a tapered or angled spline with a particular width on the darts exterior surface is pumped into a casing string having a number of devices Incorporated at strategic locations along the casing string. Each of the devices incorporated into the casing string have a slot as a part of the device. Each slot also has a particular width. As the dart passes through the devices incorporated in the casing string but towards the surface of the targeted device, the width of the tapered or angled spline is less than the minimum width of the slots in each of those upper devices. Therefore the dart does not engage or otherwise affect any of the upstream devices. However when the dart reaches the targeted device the width of the spline matches the width of the slot such that the slot captures the spline and the dart to which the spline is attached thereby sealing the wellbore at the targeted device.

14 Claims, 9 Drawing Sheets

SLOT ACTUATED DOWNHOLE TOOL

BACKGROUND

In the oilfield it has become common practice to drill a well that intersects numerous formations or portions of formations. Sometimes the well may be primarily vertical and sometimes the well may have a significant horizontal section. Once the wellbore has been drilled it is usually necessary to case the well. In the past the casing was typically a number of joints of solid pipe joined together and then run into the wellbore. Once the casing had been located in the wellbore it was then cemented in place by forcing cement through the interior of the pipe, out of the toe of the pipe, and back up around the annular area formed between the casing and the wellbore itself.

With the casing cemented in the well the interior of the pipe casing was effectively sealed from allowing any fluids to flow from the formations to the interior will. The typical practice to access the formations from the interior of the casing has been an operation referred to as plug and perf. In a plug and perf operation a bridge plug with the setting tool top of it and the perforating gun on top of the setting tool are run into the well. Once the bridge plug was located below the lower end of the desired formation zone the bridge plug was set by the setting tool thereby sealing the casing at the bridge plug and preventing any fluid from passing below the bridge plug. The setting tool is then released from the bridge plug in the setting tool and perf gun are raised some distance above the bridge plug. Once the perf gun is located adjacent to the formation to which access is desired to perf gun is fired. The perf gun is a set of shaped charges that when fired are able to pierce the casing and penetrate some distance past the casing into the formation thereby allowing fluid in the formation to flow to the interior of the casing and vice versa. Once the formation is accessed, the perf gun and setting tool are removed from the casing. Fluid is then pumped down the wellbore at high pressure, out through the perforations in the casing and into the formation, which in turn fractures the formation. Once the fracturing operation is complete the pumps at the surface are turned off. A new bridge plug setting tool and perf gun are assembled at the surface and then run into the casing. Once the second bridge plug is located below the second-highest formation, from the toe of the well, the bridge plug is set and the process is repeated until all of the various formations have been fractured. Once all of the formations are fractured, access to the lower formations through the bridge plug is necessary, therefore the usual practice is to run a drill back into the casing and drill out all of the intervening bridge plugs thereby allowing full bore access to all of the formations.

In order to avoid the costs associated with drilling out multiple bridge plugs, a slightly newer practice is to include a number of sliding sleeves in the casing before the casing is run into the well bore and cemented in place. Typically each sliding sleeve has a seat in the sliding sleeve. The seats are arranged so that the smallest diameter sliding sleeve seat is closest to the toe and the largest diameter sliding sleeve seat is closest to the surface. Each sliding sleeve is placed in the casing so that when the casing is run into the wellbore the appropriate sliding sleeve will be adjacent to the formation from which access is desired. When the operator then desires to fracture a particular formation a ball is pumped through the casing. The diameter of the ball is chosen so that it will pass through each of the larger diameter seats in the sliding sleeves closer to the surface but once it gets to the lowest sliding sleeves the ball will seat and allow no further fluid flow to pass the particular sleeve in which it is seated. Fluid pressure on the surface is then increased causing force to be exerted against the ball and its seat thereby opening the attached sliding sleeve. Once the sliding sleeve is open, the formation adjacent the sliding sleeve may then be fractured. After fracturing the formation a slightly larger diameter ball that corresponds to the seat in the next higher sleeve is pumped through the casing where the ball lands in the sleeve and the process is repeated until all of the sliding sleeves have been opened and formations fractured. After the fracturing operations are completed the balls may be allowed to flow out of the well or dissolve to allow access to the formations.

Unfortunately because the diameter of the casing has been restricted by the increasingly smaller diameters of the sleeve towards the toe of the well fracture pressure into the lower formations and production out of the lower formations is inhibited. Another issue that operators run into when they use progressively larger balls from the toe towards the heel is due to the diametric limitations of the number of balls that will fit, and hence a limited ability to be able to treat and access as many zones as possible from a single wellbore. In order to maximize the number of sliding sleeve that may be used in a well the variations from a smaller ball size to next larger ball size is kept as low as possible. Typically a ⅛ inch variation between ball sizes is seen. The limitation on size variation is due to the constraints posed by the material of the sliding sleeves ball seat, the ball itself, and the force applied to the ball and then transferred to the ball seat. For instance a ball seat may be cast-iron whereas the ball may be aluminum, plastic, composite, dissolvable, or other appropriate material. After the ball reaches the sleeve and lands on the seat pressure is applied against the ball and through the ball to the seat in order to overcome any biasing device and shift the sleeve open. However it must be kept in mind will that all of the force applied against the ball is transferred to the seat only through the balls ⅛ inch periphery that is in contact with the seat. Therefore only a limited amount of force may be applied to the ball before either the ball deforms or the periphery of the ball shears thereby allowing the ball to pass through the seat thus causing the failure of the particular sleeve.

SUMMARY

In order to overcome at least the aforementioned issues an embodiment of the present invention incorporates a dart having at least one spline lengthwise on its periphery to solve both of these problems. The spline is a protrusion outward from the surface of the dart that may be merely a key but typically is set at a slight angle to the direction of movement of the dart. The key may be forward angled or back angled but is usually tapered from a small width on its lower end to a larger width on its upper end.

The dart's tapered key may be referred to as a a tapered spline where the spline will be wider on the upper end of the dart and narrower on the lower end of the dart. The width of the spline corresponds to a particular seat in a particular sleeve or tool downhole and thereby determines which seat the dart will engage and thus which tool will be actuated. The length of the spline determines how much force may be applied against the dart when actuating the tool or when fracking into the formation.

A seat that cooperates with the dart is utilized in the downhole tool. Slightly upstream of the seat is an orienting device. The orienting device interacts with the spline on the dart to rotate the dart, if necessary, such that the spline will slide in place in the cooperative keyway in the seat. As the spline seats in the keyway the angled surface of the spline and its cooperating keyway can be constructed to provide sufficient bearing area to prevent the dart from passing through the seat in the presence of sufficient pressure to fracture the formation.

The dart is able to locate the correct seat as a function of the maximum circumferential width of the spline as compared to the minimum circumferential width of the keyway. Such that as the dart moves downhole if the spline is too slender to engage the keyway then the dart will pass through the sleeve without engaging the seat. In other words the dart passes through other seats on tools closer to the surface than the particular seat for which the dart is sized to land in. Upon reaching the particular seat the spline on the dart first interacts with orienting device. The orienting device turns the dart to align the spline with the keyway then, provided that the spline is wide enough, the spline and keyway will engage allowing the dart to open the sleeve.

DETAILED DESCRIPTION

The description that follows includes exemplary apparatus, methods, techniques, or instruction sequences that embody techniques of the inventive subject matter. However, it is understood that the described embodiments may be practiced without these specific details.

Figure 1:
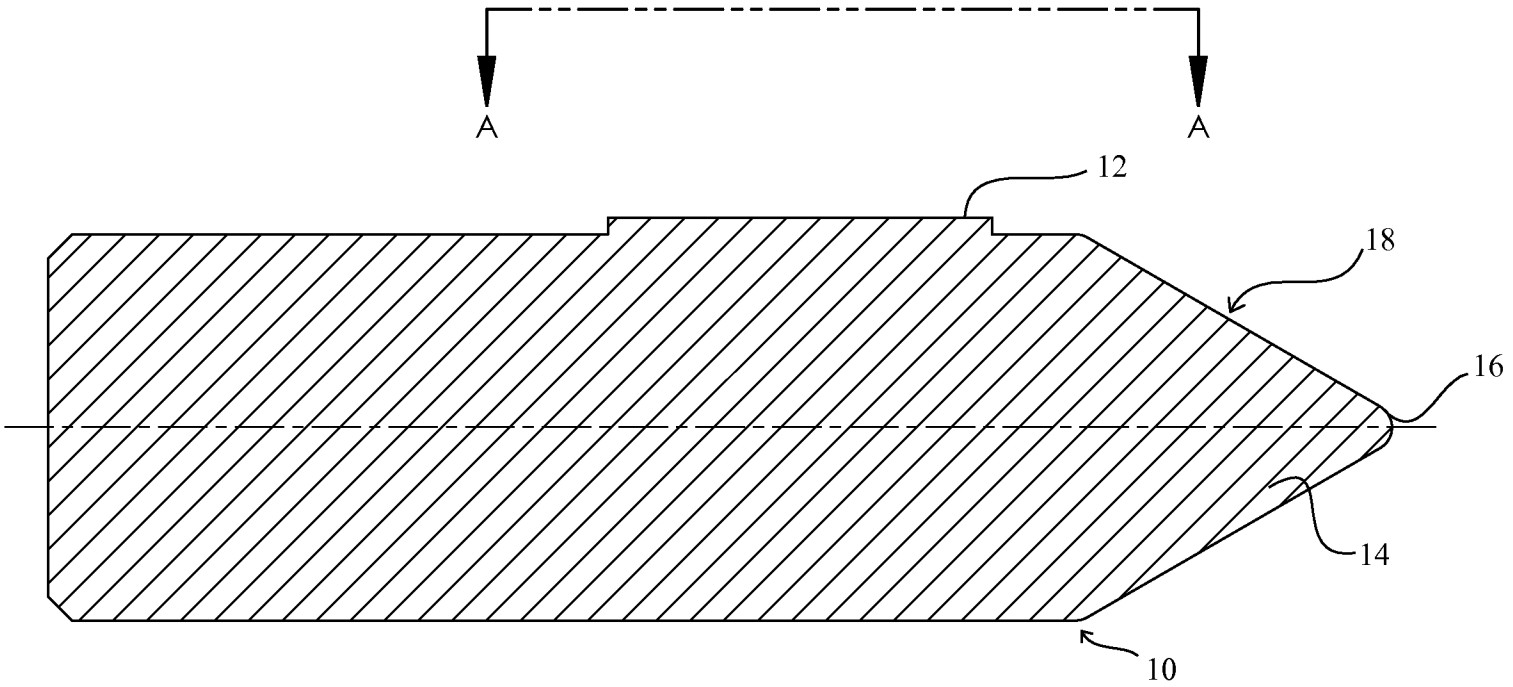
FIG. 1 is a cross-section of a dart

FIG. 1 is a cross-section of a dart 10 having a spline 12 along the longitudinal periphery of the dart 10. The dart 10 and the lower end 14 are tapered to a point 16 on the dart's leading edge 18. While a relatively sharp point is shown on the dart's leading edge 18 any shape that will allow the dart to be deflected past obstructions that might exist in the casing as the dart travels from the surface to the appropriate seat may be used. The dart 10 has a spline 12 as a portion of the length of the dart 10. In certain instances it may be desirable to maximize the length of the spline 12 so that the spline 12 extends the length of the dart 10.

Figure 2:
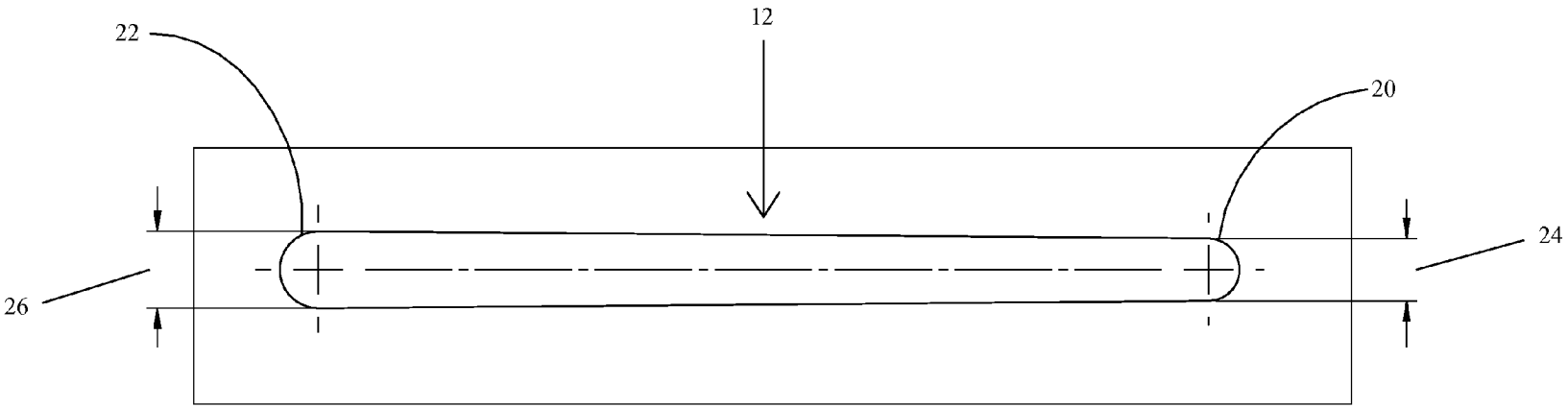
FIG. 2 is a view of the spline along the A-A line in FIG. 1.

FIG. 2 is a view of the spline 12 along the A-A line in FIG. 1. End 20 of spline 12 is oriented to be closer to the dart's leading edge while end 22 of spline 12 is oriented to be further away from the dart's leading-edge. End 20 of dart 12 is configured so that the width 24 of end 20 is less than the width 26 of end 22.

Figure 3:
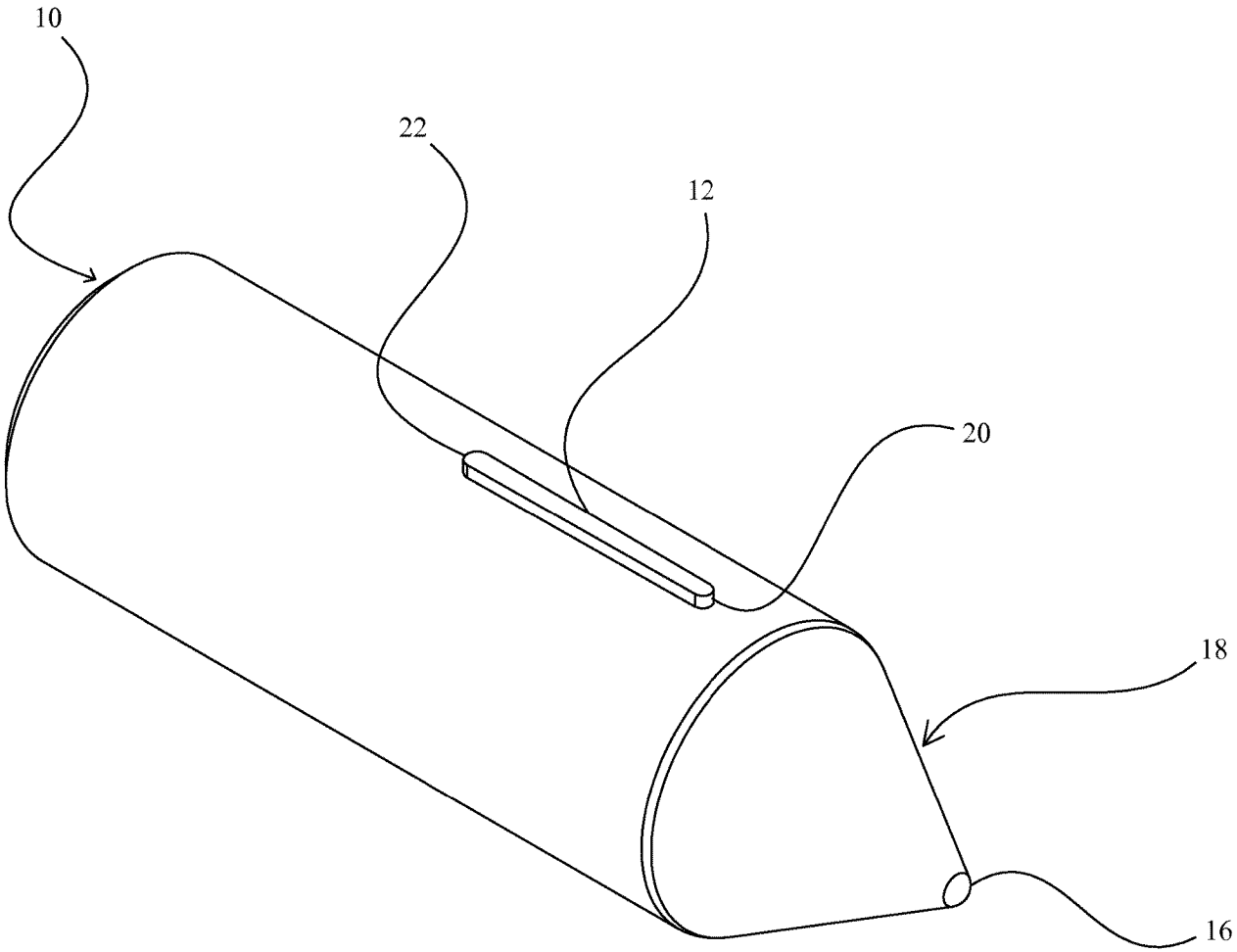
FIG. 3 is an isometric view of the dart in FIG. 1.

FIG. 3 is an isometric view of the dart 10 in FIG. 1. The spline 12 can be seen to be aligned with the longitudinal axis of the dart 10 such that the narrower end 20 is closest to the dart's leading-edge 18 and the wider end 22 is furthest from the dart's leading-edge 18. Dart 10 be made of any desired material. In certain instances it may be desirable for dart 10 to be made primarily of a dissolvable material such as polyglycolic acid. In other instances it may be desirable for the dart 10 to be made of a composite material such as resin impregnated wrapped carbon fiber. In other instances the dart may primarily be constructed of one material while the spline 12 is comprised of another material. For instance the dart may be constructed of polyglycolic acid with single or multiple pieces of a harder material such as cast-iron bonded or molded to the dart 10 as the spline 12.

Figure 4:
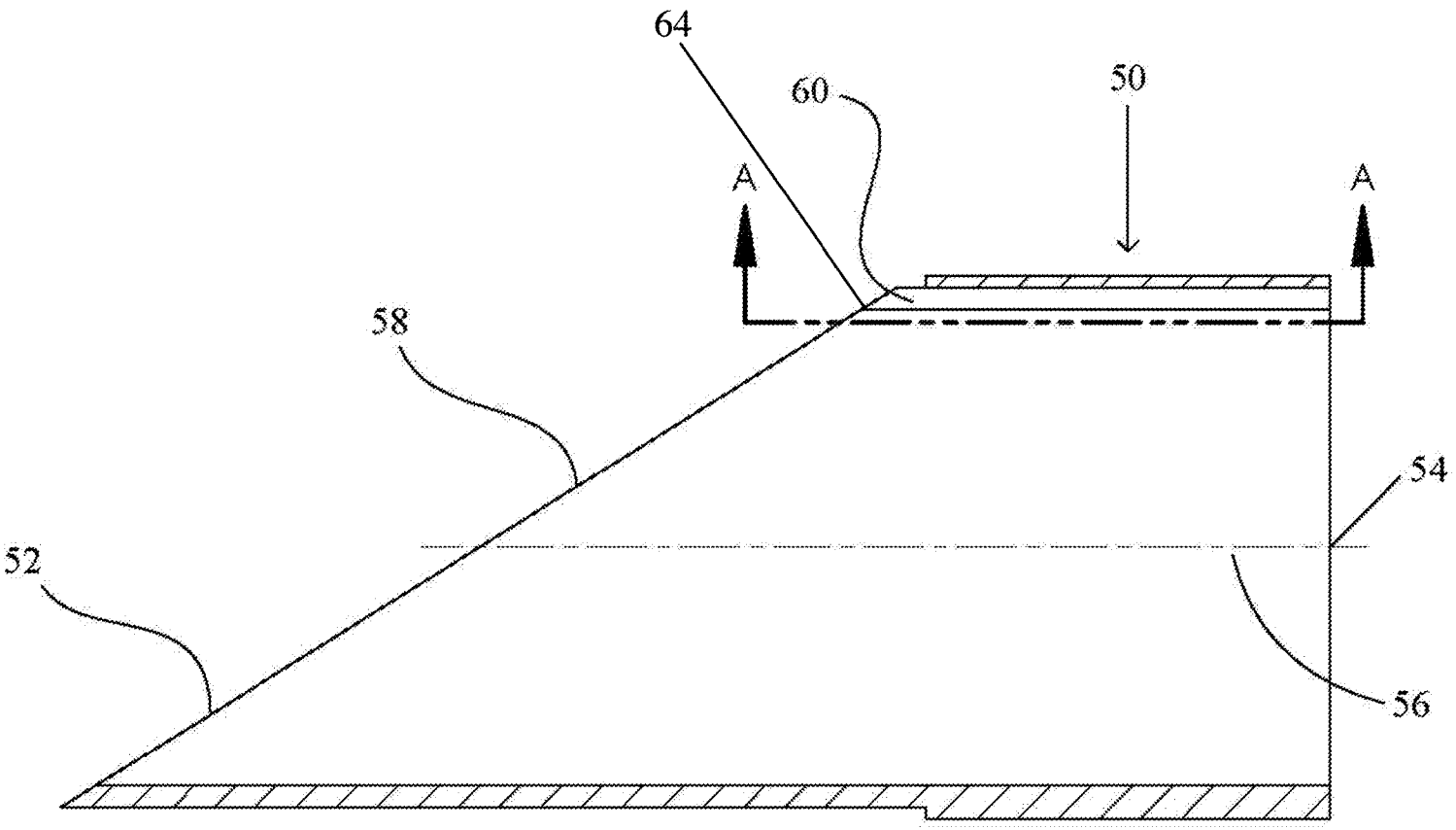
FIG. 4 is a cross-sectional view of an orienting profile.

FIG. 4 is a cross-sectional view of an orienting profile 50. The orienting profile 50 has an upper end 52 and a lower end 54. The orienting profile 56 has a surface 58 is set at an angle to the longitudinal axis 56 of the orienting profile 50. A slot 60 is formed at the lower end of surface 58. Slot 60 and surface 58 meet at interface 64.

Figure 5:
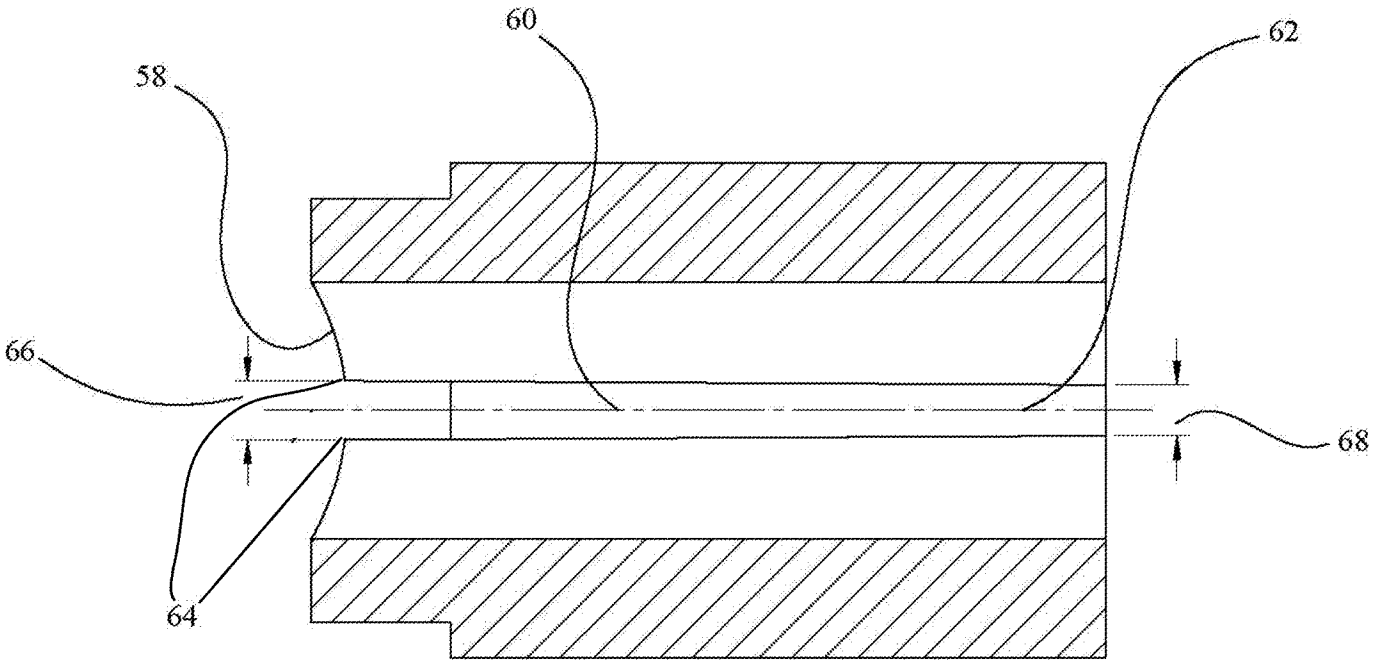
FIG. 5 is a view of the slot along the A-A line in FIG. 4.

FIG. 5 is a view of the slot 60 along the A-A line in FIG. 4. The upper end of slot 60 meets with surface 58 at interface 64 and may extend to the lower end of the orienting profile 50. The upper end of slot 60 has a width 66 that corresponds to the width 26 of spline 12. The lower end of slot 60 has a width 68 that corresponds to the width 24 of spline 12.

Figure 6:
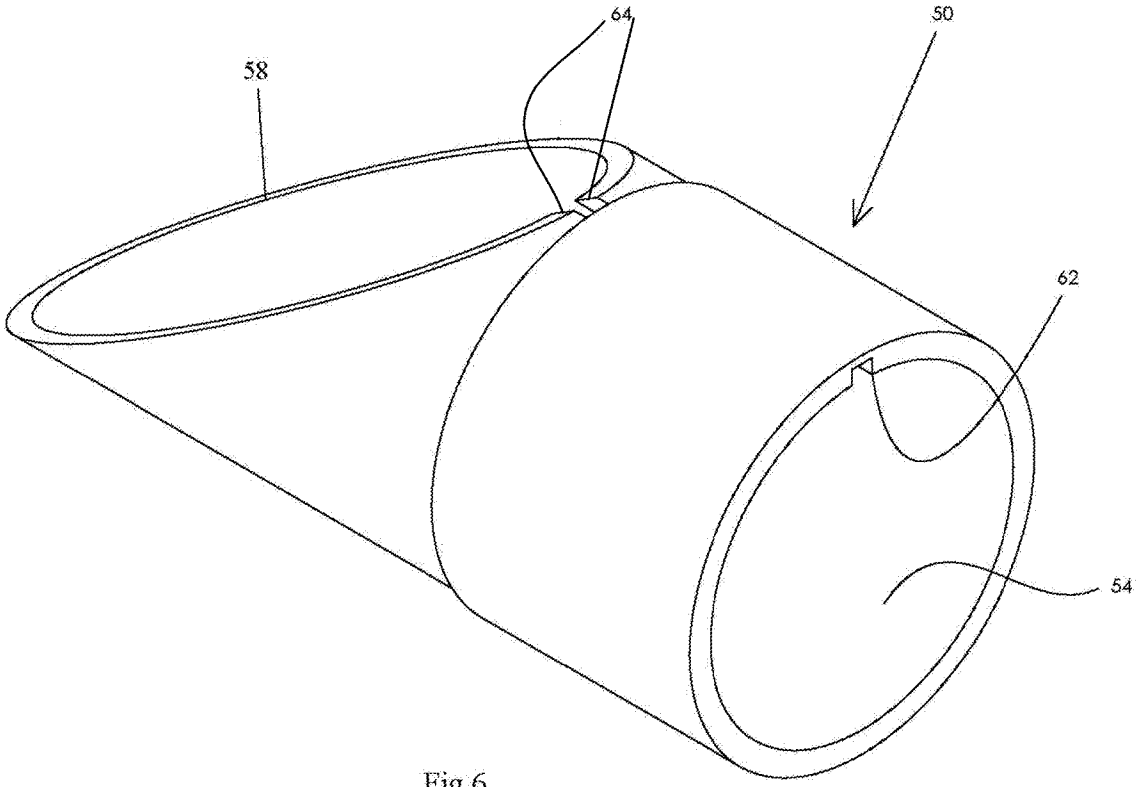
FIG. 6 is an isometric view of the orienting profile from FIG. 4.

FIG. 6 is an isometric view of the orienting profile 50 from FIG. 4. The lower end 62 of the slot 60 can be seen at the lower end 54 of the orienting profile 50. Angled surface 58 can be seen at the upper end of the orienting profile 50 as well as can be seen interface 64 were slot 60 meets surface 58.

An additional benefit of having a spline 12 with a first width 24 that increases to a larger width 26 and where that spline 12 seats in the slot 60 that also tapers from a narrower width 68 to a wider width 66 is the large load carrying capability between the spline 12 in the slot 60. The load carrying capability between the spline 12 and the slot 60 is due to the increased bearing area which is a function of the length of the spline and slot interface. In the instance that an increased load carrying capability is required, the load carrying capability of the slot and spline may be increased by lengthening the assemblies.

Figure 7:
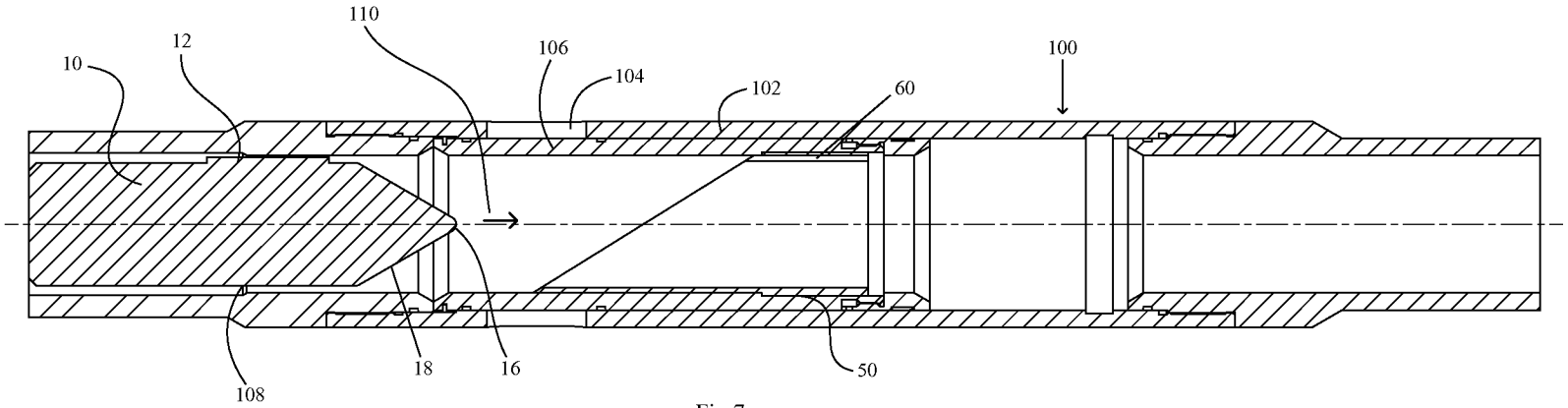
FIG. 7 depicts a sliding sleeve in its closed condition prior to being actuated.

FIG. 7 depicts a sliding sleeve 100 in its closed condition prior to being actuated. The sliding sleeve 100 has an exterior housing 102. Exterior housing 102 has a port 104. An inner sleeve 106 is coaxial with the exterior housing 102 and resides about the interior of exterior housing 102 such that in the closed condition inner sleeve 106 covers port 104. An orienting profile 50 is coaxial with inner sleeve 106 and resides about the interior of inner sleeve 106. In many instances the orienting profile 50 will be a separate assembly from inner sleeve 106 however the orienting profile 50 may in some circumstances be manufactured as a portion of the inner sleeve 106. The upper end 52 of the orienting profile 50 is aligned towards the surface and the lower end 54 of the orienting profile 50 is aligned towards the bottom of the well. Dart 10 moves through the interior of sliding sleeve 100 in the direction of arrow 110. Point 16 on dart 12 in conjunction with the tapered leading-edge 18 allows the dart to move past minor obstructions such as shoulder 108.

Figure 8:
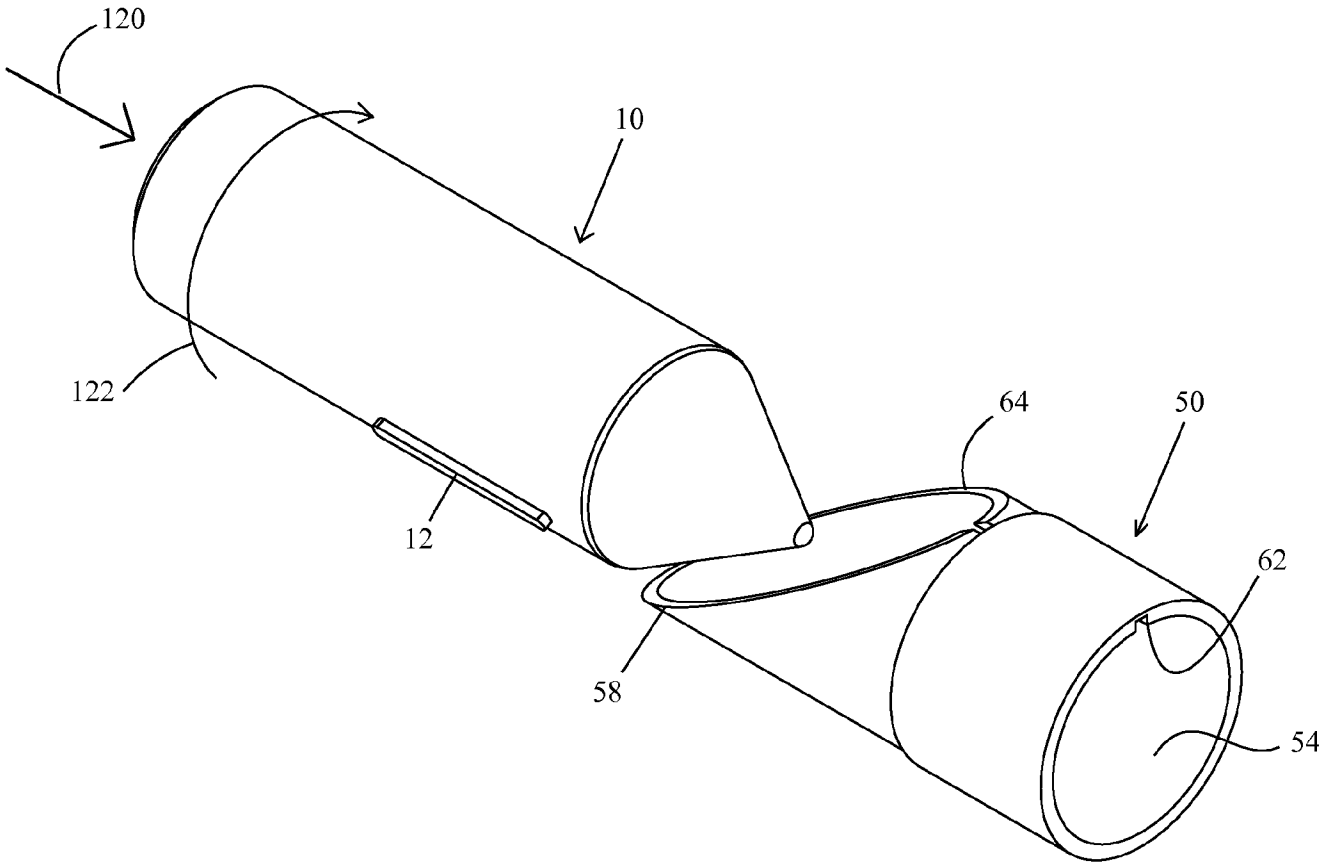
FIG. 8 depicts the interaction of an orienting sleeve and a dart.

FIG. 8 depicts the interaction of orienting sleeve 50 and dart 10. As dart 10 moves into the orienting sleeve 50, in the direction of arrow 120, spline 12 will contact surface 58. As the dart 10 continues to move into orienting sleeve 50 surface 58 will cause the dart to rotate in the direction of arrow 122 until spline 12 reaches interface 64 of slot 60. Initially as the lower end 20 of spline 12 enters the upper end interface 64 of slot 60 the width 24 of spline 12 is less than the width 66 at the upper end interface 64 of slot 60 thereby allowing spline 12 to easily enter slot 60. As spline 12 continues to move in the direction indicated by arrow 120, the lower end 20 of spline 12 reaches the lower end 62 of slot 60. However the width of spline 12 continues to increase towards the upper end 22 of spline 12 eventually reaching width 26. The greater width of spline 12 towards end 22 causes spline 12 to become wedged in slot 60 thereby locking dart 10 in place within orienting sleeve 50.

Usually multiple sliding sleeves 100 are used in a single well. In this event it is necessary to sequentially activate each sliding sleeve 100. Sequential activation begins by opening the sliding sleeve closest to the toe or bottom of the well and then fracturing the formation through the sliding sleeve. Thereafter actuating the next higher sliding sleeve fracturing the adjacent formation through the sliding sleeve and repeating the sequence until all sliding sleeves have been actuated.

In order to actuate a particular sliding sleeve the spline 12 on dart 10 has to cooperate with the orienting sleeve 50 and sliding sleeve 100. However the dart 50 must pass through any sliding sleeves that are in place above the targeted sliding sleeve 100. In order to pass through any sliding sleeves in place above the targeted sliding sleeve, the orienting sleeve utilized in any of the sliding sleeves above the targeted sliding sleeve must have a minimum width that exceeds the maximum width 26 of spline 12. By increasing the width of the spline required to seat in the slot of each higher sliding sleeve a large number of sliding sleeves may be sequentially actuated by a series of darts that each have the same outside diameter but with varying spline widths. For example assuming each spline has a 0.063" taper and a 0.063"clearance between successive spline widths, Table 1 below illustrates the number of tapered profile slots achievable in an orienting profile with a 4.5" interior diameter.

TABLE 1

| | Sleeve (Valve)# | Spline Width Bottom | Spline Width Top |
|---|---|---|---|
| Bottom (Toe) | 1 | 0.25 | 0.313 |
| | 2 | 0.376 | 0.439 |
| | 3 | 0.502 | 0.565 |
| | 4 | 0.628 | 0.691 |
| | 5 | 0.754 | 0.817 |
| | 6 | 0.88 | 0.943 |
| | 7 | 1.006 | 1.069 |
| | 8 | 1.132 | 1.195 |
| | 9 | 1.258 | 1.321 |
| | 10 | 1.384 | 1.447 |
| | 11 | 1.51 | 1.573 |
| | 12 | 1.636 | 1.699 |
| | 13 | 1.762 | 1.825 |
| | 14 | 1.888 | 1.951 |
| | 15 | 2.014 | 2.077 |
| | 16 | 2.14 | 2.203 |
| | 17 | 2.266 | 2.329 |
| | 18 | 2.392 | 2.455 |
| | 19 | 2.518 | 2.581 |
| | 20 | 2.644 | 2.707 |
| | 21 | 2.77 | 2.833 |
| | 22 | 2.896 | 2.959 |
| | 23 | 3.022 | 3.085 |
| | 24 | 3.148 | 3.211 |
| | 25 | 3.274 | 3.337 |
| | 26 | 3.4 | 3.463 |
| | 27 | 3.526 | 3.589 |
| | 28 | 3.652 | 3.715 |
| | 29 | 3.778 | 3.841 |
| | 30 | 3.904 | 3.967 |
| | 31 | 4.03 | 4.093 |
| | 32 | 4.156 | 4.219 |

TABLE 1-continued

| | Sleeve (Valve)# | Spline Width Bottom | Spline Width Top |
|---|---|---|---|
| | 33 | 4.282 | 4.345 |
| | 34 | 4.408 | 4.471 |
| | 35 | 4.534 | 4.597 |
| | 36 | 4.66 | 4.723 |
| | 37 | 4.786 | 4.849 |
| | 38 | 4.912 | 4.975 |
| | 39 | 5.038 | 5.101 |
| | 40 | 5.164 | 5.227 |
| | 41 | 5.29 | 5.353 |
| | 42 | 5.416 | 5.479 |
| | 43 | 5.542 | 5.605 |
| | 44 | 5.668 | 5.731 |
| | 45 | 5.794 | 5.857 |
| | 46 | 5.92 | 5.983 |
| | 47 | 6.046 | 6.109 |
| | 48 | 6.172 | 6.235 |
| | 49 | 6.298 | 6.361 |
| | 50 | 6.424 | 6.487 |
| | 51 | 6.55 | 6.613 |
| | 52 | 6.676 | 6.739 |
| | 53 | 6.802 | 6.865 |
| | 54 | 6.928 | 6.991 |
| | 55 | 7.054 | 7.117 |
| | 56 | 7.18 | 7.243 |
| | 57 | 7.306 | 7.369 |
| | 58 | 7.432 | 7.495 |
| | 59 | 7.558 | 7.621 |
| | 60 | 7.684 | 7.747 |
| | 61 | 7.81 | 7.873 |
| | 62 | 7.936 | 7.999 |
| | 63 | 8.062 | 8.125 |
| | 64 | 8.188 | 8.251 |
| | 65 | 8.314 | 8.377 |
| | 66 | 8.44 | 8.503 |
| | 67 | 8.566 | 8.629 |
| | 68 | 8.692 | 8.755 |
| | 69 | 8.818 | 8.881 |
| | 70 | 8.944 | 9.007 |
| | 71 | 9.07 | 9.133 |
| | 72 | 9.196 | 9.259 |
| | 73 | 9.322 | 9.385 |
| | 74 | 9.448 | 9.511 |
| | 75 | 9.574 | 9.637 |
| | 76 | 9.7 | 9.763 |
| | 77 | 9.826 | 9.889 |
| | 78 | 9.952 | 10.015 |
| | 79 | 10.078 | 10.141 |
| | 80 | 10.204 | 10.267 |
| | 81 | 10.33 | 10.393 |
| | 82 | 10.456 | 10.519 |
| | 83 | 10.582 | 10.645 |
| | 84 | 10.708 | 10.771 |
| | 85 | 10.834 | 10.897 |
| | 86 | 10.96 | 11.023 |
| | 87 | 11.086 | 11.149 |
| | 88 | 11.212 | 11.275 |
| | 89 | 11.338 | 11.401 |
| | 90 | 11.464 | 11.527 |
| | 91 | 11.59 | 11.653 |
| | 92 | 11.716 | 11.779 |
| | 93 | 11.842 | 11.905 |
| | 94 | 11.968 | 12.031 |
| | 95 | 12.094 | 12.157 |
| | 96 | 12.22 | 12.283 |
| | 97 | 12.346 | 12.409 |
| | 98 | 12.472 | 12.535 |
| | 99 | 12.598 | 12.661 |
| Top (Heel) | 100 | 12.724 | 12.787 |

Figure 9:
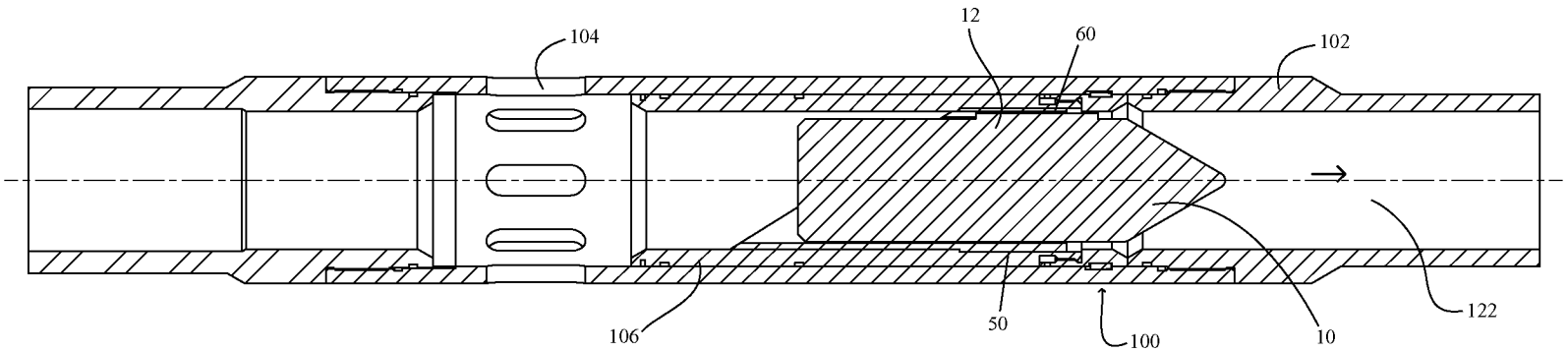
FIG. 9 depicts the sliding sleeve of FIG. 7 with the spline fully engaged in slot and the sliding sleeve in the open condition.

FIG. 9 depicts the sliding sleeve of FIG. 7 with the spline 12 fully engaged in slot 60 causing dart 10 to be seated in orienting sleeve 50 thereby sealing the interior diameter of sliding sleeve 100. With the interior diameter sliding sleeve 100 sealed against fluid flow in the direction of arrow 122, pressure may be exerted against interior sleeve 106 via the typically angled interface between spline 12 in slot 60. The fluid pressure exerted on dart 10 through orienting sleeve 50 causes sliding sleeve 106 to move towards the bottom of the well thereby exposing ports 104 and allowing the adjacent formation to be treated.

In other embodiments of the slot actuated downhole device subassemblies that include the orienting sleeve may be incorporated into the casing string. By including orienting sleeve subassemblies in various predetermined locations in the casing a dart dropped from surface would create a temporary plug in the tubing/casing inner diameter isolating particular zones thereby replacing traditional bridge plugs and allowing operators to merely perforate the casing above the temporary plug allowing a multi-zone fracture stimulation in a manner similar to the more traditional plug and perforate operations.

While the embodiments are described with reference to various implementations and exploitations, it will be understood that these embodiments are illustrative and that the scope of the inventive subject matter is not limited to them. Many variations, modifications, additions and improvements are possible.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A downhole device comprising, a dart having a spline, a seat, an orienting profile having a slot, wherein the orienting profile engages the spline to guide the spline into the seat, wherein the slot is tapered along a longitudinal axis of the downhole device and the slot is open at a top end of the slot and is open at a bottom end of the slot.

2. The downhole device of claim 1 wherein, the spline has a first side wherein the first side is parallel to a longitudinal axis of the dart and a second side, wherein the second side is at an angle to the longitudinal axis of the dart.

3. The downhole device of claim 1 wherein, the dart is at least partially a dissolvable material.

4. A downhole device comprising, a first dart having a tapered spline, wherein the tapered spline has a maximum width, an orienting profile having a slot with a cooperating width, wherein the slot is tapered along a longitudinal axis of the downhole device and the slot is open at a top end of the slot and is open at a bottom end of the slot, wherein a second dart having a spline with a width that is less than the cooperating width passes through the orienting profile without stopping, and further wherein the slot engages the tapered spline of the first dart stopping the dart.

5. The downhole device of claim 4 wherein, the tapered spline has a first side wherein the first side is parallel to a longitudinal axis of the first dart and a second side, wherein the second side is at an angle to the longitudinal axis of the first dart.

6. The downhole device of claim 4 wherein, the first dart is at least partially a dissolvable material.

7. The downhole device of claim 4 wherein, the orienting profile engages the tapered spline to rotate the first dart.

8. The downhole device of claim 4 wherein, the orienting profile engages the tapered spline to align the tapered spline with the slot.

9. A downhole device comprising, a dart having at least one tapered spline, wherein the at least one tapered spline has a first width, a second width, and a length, an orienting profile having at least one tapered slot, wherein the at least one tapered slot has a first width, a second width, and a length, further wherein the first width, the second width, and the length of the tapered slot cooperate with the first width, the second width, and the length of the tapered spline to engage the dart, wherein the tapered slot is tapered along a longitudinal axis of the downhole device and the tapered slot is open at a top end of the tapered slot and is open at a bottom end of the tapered slot.

10. The downhole device of claim 9 wherein, the first width, the second width, or the length of the at least one tapered slot and the first width, the second width, or the length of the at least one tapered spline are varied to correspond to vary a bearing surface of the at least one tapered spline and a bearing surface of the at least one tapered slot.

11. The downhole device of claim 9 wherein, the at least one tapered spline has a first side wherein the first side is parallel to a longitudinal axis of the at least one dart and a second side, wherein the second side is at an angle to the longitudinal axis of the at least one dart.

12. The downhole device of claim 9 wherein, the at least one dart is at least partially a dissolvable material.

13. The downhole device of claim 9 wherein, the orienting profile engages the at least one tapered spline to rotate the at least one dart.

14. The downhole device of claim 9 wherein, the orienting profile engages the at least one tapered spline to align the at least one tapered spline with the at least one tapered slot.

* * * * *